United States Patent [19]

Deline

[11] Patent Number: 4,597,735

[45] Date of Patent: Jul. 1, 1986

[54] HIGH-EFFICIENCY PORCELAIN ENAMELING FURNACE

[75] Inventor: Roger B. Deline, Port Colborne, Canada

[73] Assignee: Can-Eng Holdings, Ltd., Canada

[21] Appl. No.: 762,691

[22] Filed: Aug. 5, 1985

[51] Int. Cl.[4] ..... F24C 3/00; F27D 3/00; F27D 15/00; F27B 5/14

[52] U.S. Cl. ..... 432/11; 126/91 A; 432/82; 432/148; 432/209

[58] Field of Search ..... 432/82, 128, 148, 209, 432/11; 126/91 A

[56] References Cited

U.S. PATENT DOCUMENTS

| | | | |
|---|---|---|---|
| 2,162,041 | 6/1939 | Weller | 432/82 |
| 2,608,740 | 9/1952 | Dany | 432/82 |
| 4,310,300 | 1/1982 | Mackenzie | 432/209 |

*Primary Examiner*—John J. Camby

*Attorney, Agent, or Firm*—Davis Chin

[57] ABSTRACT

A procelain enameling furnace includes a combined entrance/exit zone, an air seal section, a radiation/convection heat transfer section, and a heating section. The entrance/exit zone receives an incoming cool ware and discharges an outgoing hot ware at substantially the same location. The air seal section prevents loss of heat from the furnace through the entrance/exit zone. In the heat transfer section, the incoming ware is parallel to and travels in the opposite direction to the outgoing ware for transferring heat therebetween by radiation and convection. The heating section includes a pre-heating zone and at least one heating zone. The pre-heating zone is formed of U-shaped heat exchanger tubes through which the incoming ware passes following the heat transfer section. The heating zone is formed of U-shaped radiant heating tubes for heating the cool ware following the pre-heating zone.

18 Claims, 3 Drawing Figures

HIGH-EFFICIENCY PORCELAIN ENAMELING FURNACE

BACKGROUND OF THE INVENTION

This invention relates generally to continuous porcelain enameling furnaces and more particularly, it relates to an improved porcelain enameling furnace which operates on an effective and efficient fuel basis. More specifically, the porcelain enamel furnace of this invention has a heat transfer section in which the incoming cool ware is parallel to and travels in the opposite direction to the outgoing hot ware, thereby permitting efficient heat transfer by radiation and convection to occur. The instant porcelain enameling furnace includes U-shaped radiant heating tubes in the heating section for facilitating uniformity of temperature from top to bottom of the porcelain enamel ware therein.

The present invention is generally directed to improvements made over U.S. Pat. No. 4,310,300 which issued on Jan. 12, 1982 and is entitled "Furnace for Porcelain Enameling". Such patent is hereby incorporated by reference. Due to the particular configuration of the present furnace, the outside wall area is reduced for the same conveyor length and production capacity as the furnace in the '300 patent, thereby permitting a more compact layout. Further, this design configuration includes a heat transfer section in which the incoming cooling ware and the outgoing hot ware are arranged in a side-by-side or parallel relationship to provide efficient heat transfer therebetween.

In the above patent, gases from a burner combust in a plurality of serpentine radient tube units in the heating zone which are disposed on opposite sides of the furnace. Then, the products of combustion from the radiant tube units are collected by a pair of manifold pipes arranged on the inside of the heating zone. This suffers from the disadvantage of being inefficient in releasing an appreciable amount of heat since the manifold pipes are inside of the heating zone. On the other hand, the present furnace is provided with U-shaped radiant heating tubes which extend vertically downward adjacent the outside wall, horizontally across the floor, and vertically up adjacent the inside wall so as to effect an even distribution of heat within the heating section.

Further, the products of combustion are collected in an external exhaust collector duct for delivery to U-shaped hear exchanger tubes formed in the pre-heating section. The external exhaust collector duct is preferable refractory lined and serves to replace the internal manifold pipes of the '300 patent which are made of an expensive alloy, thereby reducing the maintenance and replacement costs. The products of combustion may then be passed through an external preheat collector duct to either a frit dryer oven or a heat transfer device via a hot fan and an insulated dryer duct. As a result, most of the thermal energy in the combustion product has been utilized or reclaimed to facilitate an initial heating of the cool ware. Thus, the temperature of the spent exhaust gases to be vented from the dryer oven into the atmosphere will be at a relatively low temperature such as approximately 200°-300° F.

SUMMARY OF THE INVENTION

Accordingly, it is a general object of the present invention to provide an improved porcelain enameling furnace which operates on an effective and efficient fuel basis, but yet overcomes the disadvantages of the prior art enameling furnaces.

It is an object of the present invention to provide a porcelain enameling furnace which has a heat transfer section in which the incoming cool ware is parallel to and travels in the opposite direction to the outgoing hot ware so as to permit heat transfer by radiation and convection.

It is another object of the present invention to provide a porcelain enameling furnace which includes U-shaped radiant heating tubes in the heating section for facilitating uniformity of temperature from top to bottom of the porcelain enamel ware therein.

It is still another object of the present invention to provide a porcelain enameling furnace which includes an external exhaust collector duct for delivering the products of combustion of the heating zones to U-shaped heat exchanger tubes formed in the pre-heating zone.

It is still yet another object of the present invention to provide a method for fusing a porcelain enamel coating onto a piece of ware by passing combustion gases into U-shaped radiant tubes in the heating zones to heat the ware by radiation.

In accordance with these aims and objectives, the present invention is concerned with the provision of a porcelain enameling furnace which includes a monorail conveyor for transporting a ware to be fused with a porcelain enamel coating successively through a combined entrance/exit zone, an air seal section, a radiation/convection heat transfer section and a heating section. The entrance/exit zone receives an incoming cool ware and discharges an outgoing ware at substantially the same location. The air seal section prevents loss of heat from the furnace through the entrance/exit zone. It the heat transfer section, the incoming cool ware is parallel to and travels in the opposite direction to the outgoing hot ware for transfering heat therebetween by radiation and convection. The heating section includes a preheating zone, a first heating zone, a second heating zone, and a third heating zone. The preheating zone is formed of U-shaped heat exchanger through which the incoming ware passes following the heat transfer section. Each of the heating zones is formed of U-shaped radiant heating tubes for heating the cool ware following the pre-heating zone. A burner supplies a mixture of air and gas which combust in the radiant heating tubes to heat the same to a temperature sufficient to fuse the enamel coating onto the hot ware by radiation.

A heat exchanger and cooling section includes a hot ware cooling zone which is located before the entrance/exit zone for cooling the hot ware and for transferring heat across the surfaces from the hot ware to the cool ware so as to initially heat the same by convection prior to entering the furnace. An exhaust collector duct is disposed outside of the heating zones for directing the combustion gases from the U-shaped radiant tubes into U-shaped heat exchanger tubes in the pre-heating zone for pre-heating the cool ware by radiation. The heating exchanger and cooling section also includes a drying zone disposed adjacent and parallel to the hot ware ware cooling zone. Conduits are provided for directing the combustion gases from the U-shaped heat exchanger tubes into the drying zone for further initial heating of the cool ware by convection. The spent combustion gases from the heat exchanger and cooling section is discharged to the atmosphere at the a relatively low temperature.

BRIEF DESCRIPTION OF THE DRAWINGS

These and other objects and advantages of the present invention will become more fully apparent from the following detailed description when read in conjunction with the accompanying drawings with like reference numerals indicating corresponding parts throughout, wherein.

DESCRIPTION OF THE PREFERRED EMBODIMENTS

Figure 1:
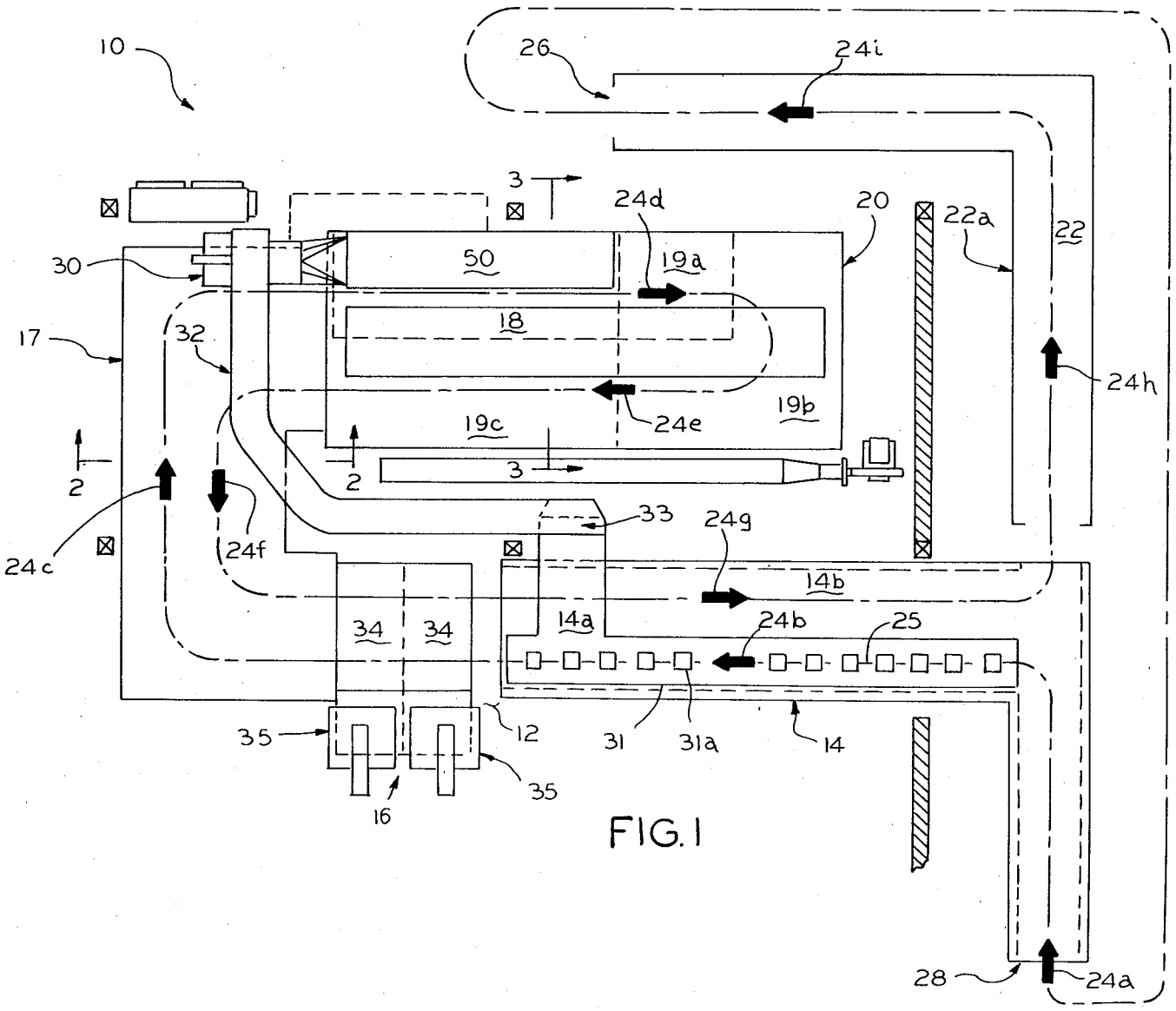
FIG. 1 is a schematic of a top plan view of a porcelain enameling furnace embodying the features of the present invention.

Referring now in detail to the various views of the drawings, there is shown in FIG. 1 a high-efficiency porcelain enameling furnace 10 embodying the features of the present invention. The furnace 10 includes a series of successive stages consisting of a combined entrance/exit zone 12, an air seal section 16, a radiation/convection heat transfer section 17, pre-heating zone 18, and a heating section 20. The heating section 20 includes a pre-heating zone 18, a first heating 19*a* a second heating 19*b* and a third heating zone 19*c*. While there are illustrated three heating zones, it should be understood by those skilled in the art that any number of heating zones may be used as is desired dependent upon the physical size of the furnace. External to the furnace, there are provided a heat exchanger and cooling section formed of a frit dryer oven 14 and a cooling zone 22 which will be explained in more detailed herinafter.

A ware such as articles formed of metal or the like travels through the various stages of the furnace in the direction of the arrows 24*a* through 24*b* by a conventional continously moving overhead monorail conveyor chain 25 which may be driven by any suitable driving mechanism. It can be seen that there is a considerable distance for the conveyor chain 25 to travel after leaving a discharge end 26 of the cooling zone before reentering the intake end 28 for transport to the entrance/exit zone 12. This permits the loading of the cool ware for heating and unloading of the hot ware which has been finished by attendants or operators.

After the cool ware enters the intake end 28, it is passed through a drying zone 14*a* in the frit dryer oven 14 for contacting with hot gases from the pre-heating zone 18 supplied thereto by means of a hot fan 30 and an insulated dryer duct 32. It should be appreciated that the frit dryer oven 14 is only necessary or desired when the porcelain enamel frit is applied to the surface of the ware as a wet deposit such as by spraying or dipping. On the other hand, when the enamel frit is applied by a dry process such as an electrostatically dry power then the heat exchanger and cooling section may be formed as a waste heat boiler, air-to-air exchanger or any other direct/indirect heat exchanger equipment. The hot gases enter the drying zone 14*a* through a supply plenum 33 and is circulated over the wet frit applied to the ware by means of a duct 31 with openings 31*a* connected to the plenum 33. The dryer oven 14 also includes a hot ware cooling zone 14*b* disposed adjacent and parallel to the drying zone which provides waste heat from the hot ware to be in heat exchange relationship with the cool ware. The hot gases and waste heat serve as heat sources to initially heat the cool ware along the arrow 24*b*, thereby removing moisture from the ware being passed through the drying zone 14*a* prior to entering the furnace. After an appreciable amount of the usable exhaust heat has been removed from the gases in the drying zone 14*a*, it may be vented out of the oven by suitable exhaust and duct means located on the roof of the drying zone to the atmosphere at a relatively low temperature such as approximately 200°-300° F.

Figure 2:
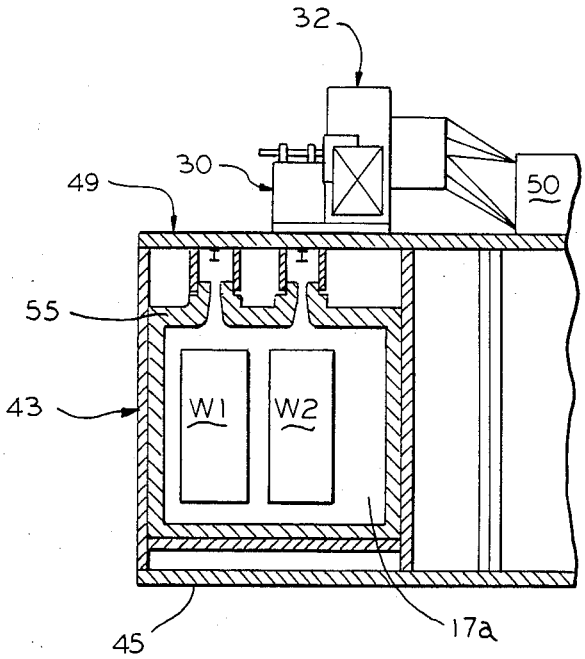
FIG. 2 is a cross-sectional view taken along the lines 2—2 of FIG. 1, illustrating the heat transfer section following the dual air seal.

The dried ware is then passed through dual air seals 34 in the air seal section 16 which are arranged in tandem to provide a double seal effect. The air seals serve to isolate the entrance/exit zone 12 of the furnace from the ambient temperature so as to minimize loss of the heated air. The air is distributed in the air seal section preferably from top to bottom by conventional motor-driven blowers 35 and adjustable air flow vanes in each of the respective air seals 34. After the ware passes through the dual air seals 34 and before it goes into the pre-heating zone 18 of the hearing section 20, it will be moving through the radiation/convection heat transfer section 17 in the direction of the arrow 24*c*, which is best illustrated in FIG. 2 of the drawings.

In the radiation/convection transfer chamber 17*a* of the heat transfer section, the incoming cool ware W1 will be traveling in the direction of the arrow 24*c* which is parrallel to and in the opposite direction of the outgoing hot ware W2 traveling in the direction of the arrow 24*f*. In this heat transfer section, the heat in the ware leaving the third heating zone 19*c* will be transfer by both radiation and convection to pre-heat the ware coming from the air seal section 16 prior to entering the pre-heating zone 18.

Figure 3:
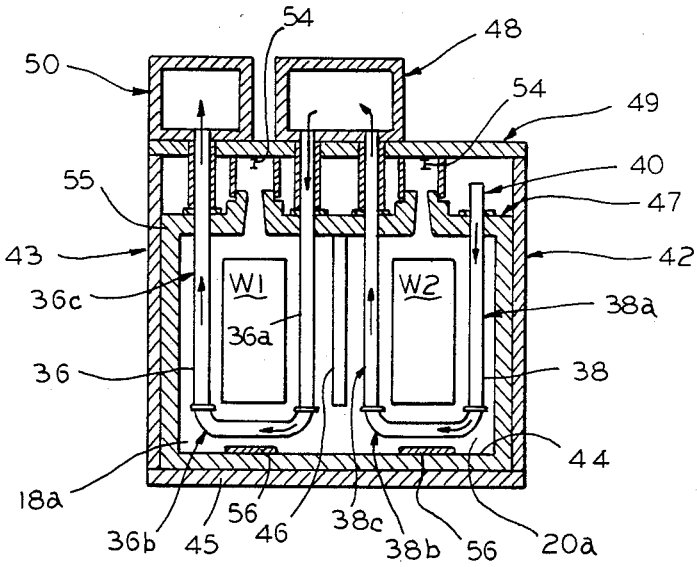
FIG. 3 is a cross-sectional view taken along the lines 3—3 of FIG. 1, illustrating the heating section formed of the pre-heating and heating zones.

Next, the cool ware W1 is pre-heated in the pre-heating chamber 18*a* in the pre-heating zone 18 by flowing of hot gases through the U-shaped heat exchanger tubes 36, the gases being generated from the succeeding heating zones 19*a*, 19*b* and 19*c* in the heating section 20. The pre-heating chamber 18*a* of the pre-heating zone 18 and the adjacent heating chamber 20*a* of the third heating zone 19*c* are best illustrated in FIG. 3 of the drawings. As illustrated, the heating chamber 20*a* in the heating zone 19*c* includes U-shaped internally fired radiant heating tube 38 which receives a mixture of air and gas from a gas-fired burner 40. The radiant heating tubes includes a first portion 38*a* extending vertically downward adjacent an outside wall 42 of the furnace, a second portion 38*b* extending horizontally across a floor 44 adjacent a bottom base 45, and a third portion 38*c* extending vertically upward adjacent an inside insulating curtain wall 46. Due to the arrangement of the second portion 38*b* which extends horizontally across the floor, heat is transferred to the lower section of the heating chamber 20*a* so that uniformity of temperature is obtained from top to bottom of the enamel ware.

While only the heating chamber 20*a* in the third heating zone 19*c* as been described in detailed structurally relative to the burner and radiate heating tubes, it should be clearly understood that each of the other heating zones 19*a* and 19*b* are similarly constructed with these components. Each of the respective first, second and third heating zone 19*a*, 19*b* and 19*c* defined a separate zone of temperature control.

The vertical positions 38*a* and 38*c* of the U-shaped radiant heating tubes are provided with upper sections which extend through and are supported by a roof 47 of the furnace. The insulating curtain wall 46 is disposed between the pre-heating chamber and the heating chamber in the third hearing zone 19*c* which are located in a side-by-side or parallel relationship. The curtan wall 46 may be supported from the radiant tubes or may be suspended by suitable means from the roof 47 of the furnace.

In the heating chamber 20*a*, the porcelain enamel frit which has been applied to the surface of the ware as a wet deposit before being introduced into the drying zone 14*a* is fused to form the porcelain enamel coating following pre-heating. The products of combustion from the fuel fired radiant tubes 38 are then collected outside of the heating chamber 20*a* by a burner exhaust collector duct 48. Thereafter, the combustion gases are passed into the U-shaped heat exchanger tubes 36 which are formed of a first portion 36*a* extending vertically down adjacent the inside curtain wall 46, a second portion 36*b* extending horizontally across the floor 44 adjacent the bottom base 45, and a third portion 36*c* extending vertically upward adjacent an outside wall 43 of the furnace. The vertical portions 36*a* and 36*c* of the heat exchanger tubes have upper sections which extend through and are supported by the roof 47 of the furnace. The hot gases from the heat exchanger tubes 36 are next collected outside of the pre-heating chamber 18*a* by a preheat collector duct 50 for delivering to the hot fan 30 and finally to the drying zone 14*a* in the frit dryer oven 14 via the insulated duct 32, the supply plenum 33 and the duct 31 with openings 31*a*.

As can be seen, the exhaust collector duct 48 is disposed above and outside the heating chamber 20*a* so as to effect further efficient heat transfer in the pre-heating chamber 18*a*. This exhaust duct 48 may preferably be integrated into the roof 47 and structural members 49 at a location between the monorail conveyor chains which are adapted for connection to the I-beams 54. The exhaust duct 48 is utilized to prevent the loss of heat in the heating chamber 20*a* to the cooler exhaust gases. The walls 42 and 43, the bottom base 45 and the roof 47 of the furnace are lined with one or more layers of suitable refractory material 55 such as ceramic fiber and the like. The ceramic floor 44 of the furnace 10 may include a refractory walkway 56.

After passing through the heating zone 20, the ware W2 is passed back through the heat transfer section 17, the dual air seals 34 and the frit dryer oven 14 along the arrows 24*f* and 24*g* before delivery to the cooling zone 22 formed of a L-shaped cooler tunnel 22*a*. The ware in the cooling zone travels along the arrows 24*h* and 24*i* where its temperature is reduced to a level which can be conveniently manipulated by the attendant or operator. Finally, the ware exits at the discharge end 26 of the cooling zone 22.

The furnace 10 of the present invention has been designed in a particular configuration in which the entrance zone 12 for the incoming ware W1 is at substantially the same location as the exit zone 12 for the outgoing hot ware W2. As can be seen from FIG. 1, the incoming cool ware is parallel to and travels in a direction opposite to the outgoing hot ware in the heat transfer section 17. This permits heat recovery or reclaiming of the heat from the hot ware W2 to the cool ware W1 by natural radiation and convection.

In operation, the mixture of air and gas is provided by the gas-fueled burner 40 located on the roof 47 for delivery to the upper end of the first portion 38*a* of the U-shaped radiant tubes where combustion takes place. Heat is transferred to the surfaces of the radiant tubes 38 which, in turn, radiate heat to the heating chamber 20*a* for heating the enamel ware to a temperature sufficient to fuse the enamel onto the ware by radiation. Since there is no direct contact of the products of combustion with the ware, the possibility of contamination of the furnace air atmosphere is prevented. As indicated by arrows in FIG. 3, the flow of the combustion gases travel through the radiant tube portions 38*a* through 38*c* and upward into the exhaust collector duct 48. From this duct 48, the gases travel down into and through the heat exchanger tube portions 36*a* through 36*c* in the pre-heating chamber 18*a* which serves to pre-heat the ware by heat transfer by radiation. Also, due to the arrangement of the cool and hot wares being adjacent in a side-by-side relationship with each other in the heat transfer zone 17, additional heat transfer from the hot ware W2 to the cool ware W1 will take place by radiation and convection which makes possible an effective and efficient use of the thermal energy contained in the hot combustion gases. Typically, the temperature of the hot ware W2 leaving the third heating zone 19*c* will be at approximately 1400° F. and the temperature of the cool ware W1 entering the pre-heating zone 18 will be at approximately 200° F.

After this, the combustion gases are collected by the pre-heat collector duct 50 and directed by the hot fan 30 and the insulated dryer duct 32 to the drying zone 14*a* via the supply plenum 33 and the duct 31 with openings 31*a*. The combustion gases from the pre-heat collector duct 50 will be circulated over the cool ware in the drying zone 14*a* so as to effect heat transfer thereto by convection so as to reclaim the exhaust heat before discharging of the same from the drying zone 14*a*. Further, the hot ware W2 in the hot ware cooling zone 14*b* will provide waste heat to effect further heat transfer by convection to the cooling ware W1 in the drying zone 14*a*. Both the combustion gases and waste heat serve to initially heat the cool ware W1 prior to entering the furnace. An exhaust fan (not shown) is be located on the roof of the drying zone 14*a* to exhaust the spent combustion gases to the outside atmosphere at a relatively low temperature, thereby maximizing the heat recovery or extraction from the spent exhaust gases prior to releasing it from the furnace.

From the foregoing detailed description, it can thus be seen that the present invention provides an improved porcelain enameling furnace having a heat transfer section in which the incoming cool ware is parallel to and travels in the opposite direction to the outgoing hot ware so as to permit efficient heat transfer therebetween by radiation and convection. Further, each of the heating zones is provided with U-shaped radiant heating tubes which extend vertically downward on the outside wall, horizontally across the floor and vertically upward on the inside wall so as to effect an even distribution of heat within the heating chamber.

While there has been illustrated and described what is at present to a preferred embodiment of the present invention, it will be understood by those skilled in the art that various changes may be made, and equivalents may be substituted for elements thereof without departing from the true scope of the invention. In addition, many modifications may be made to adapt a particular situation or material to the teachings of the invention without departing from the central scope thereof. Therefore, it is intended that this invention not be limited to the particular embodiment disclosed as the best mode contemplated for carrying out this invention, but that the invention will include all embodiments falling within the scope of the appended claims. s been illustrated and described what is at present to be a preferred embodiment of the present invention, it will be understood by those skilled in the art that various changes may be made, and equivalents may be substituted for elements thereof without departing from the true scope of the invention. In addition, many modifications may be made to adapt a particular situation or material to the teachings of the invention without departing from the central scope thereof. Therefore, it is intended that this invention not be limited to the particular embodiment disclosed as the best mode contemplated for carrying out this invention, but that the invention will include all embodiments falling within the scope of the appended claims.

What is claimed is:

1. A porcelain enameling furnace comprising:

entrance/exit means for receiving an incoming cool ware and for discharging of an outgoing hot ware at substantially the same location;

heat transfer means located after said entrance/exit means for transfering heat from the hot ware to the cool ware by radiation and convection;

pre-heating means formed of U-shaped heat exchanger tubes through which the incoming cool ware passes following said heat transfer means;

heating means formed of U-shaped radiant heating tubes for heating the cool ware following said pre-heating means;

heat exchanger and cooling means including a hot ware cooling zone located before said entrance/exit means for cooling the hot ware and for transferring heat across the surfaces from the hot ware to the cool ware so as to initally heat the same by convection;

burner means for supplying a mixture of air and gas which combust in said radiant heating tubes to heat the same to a temperature sufficient to fuse an enamel coating onto the hot ware by radiation;

duct means disposed outside of said heating means for directing the combustion gases from said U-shaped radiant tubes into said U-shaped heat exchanger tubes for pre-heating the cool ware by radiation;

said heat exchanger and cooling means including a drying zone disposed adjacent and parallel to said hot ware cooling zone;

conduit means disposed outside of said pre-heating means for directing the combustion gases from said U-shaped heat exchanger tubes into said drying zone for further initially heating of the cool ware by convection; and exhaust means for discharging spend combustion gases from said drying zone to the atmosphere at a relatively low temperature.

2. A porcelain enameling furnace as claimed in claim 1, wherein said U-shaped radiant heating tubes includes a first portion extending vertically downward adjacent an outside wall, a second portion extending horizontally across a floor and a third portion extending vertically upward adjacent an inside wall.

3. A porcelain enameling furnace as claimed in claim 1, wherein said U-shaped heat exchanger tubes includes a first portion extending vertically downward adjacent an inside wall, a second portion extending horizontally across a floor and a third portion extending vertically upward adjacent an outside wall.

4. A porcelain enameling furnace as claimed in claim 1, wherein said duct means comprises an exhaust collector duct which is formed integrally into the roof and structural members of the furnace.

5. A porcelain enameling furnace as claimed in claim 1, wherein said conduit means comprises a pre-heat collector duct, a hot fan for directing the combustion gases into an insulated dryer duct, a supply plenum for receiving the gases from the insulated duct and a duct with openings connected to the plenum for delivering into the drying zone.

6. A porcelain enameling furnace as claimed in claim 1, further comprising an insulating curtain disposed between the pre-heating means and the heating means which is suspended from the roof of the furnace.

7. A porcelain enameling furnace as claimed in claim 1, further comprising an air seal section disposed between said entrance/exit means and said heat transfer means for isolating the furnace from the ambient atmosphere.

8. A porcelain enameling furnace as claimed in claim 1, further comprising means for conveying the ware to be coated with an enamel successively to said heat transfer, pre-heating, and heating means.

9. A procelain enameling furnace as claimed in claim 1, further comprising a L-shaped color tunnel located following said heat exchanger and cooling means.

10. A method for fusing a porcelain coating onto a piece of ware, said method comprising the steps of:

passing said ware sequentially through a heat transfer section, a pre-heating zone, a heating zone and a heat exchanger zone;

transferring heat from outgoing ware to incoming cool ware in the heat transfer section by radiation and convection;

passing combustion gases into U-shaped radiant tubes in the heating zone to heat said ware by radiation;

collecting said combustion gases outside of said heating zone;

passing said collected combustion gases from said heating zone into U-shaped heat exchanger tubes in said pre-heating zone for pre-heating said ware by radiation;

passing said combustion gases from said pre-heating zone to said heat exchanger zone for initially heating of the incoming ware by convection; and exhausting said combustion gases from said heat exchanger.

11. A method as claimed in claim 11, further comprising the step of providing an air seal section located before the heat transfer zone for isolating the furnace from the ambient atmosphere.

12. A method as claimed in claim 10, further comprising the step of providing an insulating curtain disposed between the pre-heating zone and the heating zone which is suspended from the roof of the furnace.

13. A porcelain enameling furnace comprising:

entrance/exit means for receiving an incoming cool ware and for discharging an outgoing hot ware at substantially the same location;

heat transfer means located after said entrance/exit means for transferring heat from the hot ware to the cool ware by radiation and convection;

heating section means for heating the cool ware to a temperature sufficient to fuse an enamel frit thereon by radiation following said heat transfer means; and said heating section means including a pre-heating zone and at least one heating zone, said at least one heating zone being formed of U-shaped radiant heating tubes having a first portion extending vertically downward adjacent an outside wall, a second portion extending horizontally across a floor and a third portion extending vertically upward adjacent an inside wall.

14. A porcelain enameling furnace as claimed in claim 13, wherein said heat transfer means comprises a heat transfer section in which the incoming cool ware is parallel to and travels in the direction opposite to the outgoing hot ware.

15. A porcelain enameling furnace as claimed in claim 13, wherein said pre-heating zone is formed of U-shaped heat exchanger tubes having a first portion extending vertically downward adjacent an inside wall, a second portion extending horizontally across a floor and a third portion extending vertically upward adjacent an outside.

16. A porcelain enameling furnace as claimed in claim 15, further comprising duct means disposed outside of said at least one heating zone for directing the combustion gases from said U-shaped radiant tubes into said U-shaped heat exchanger tubes for pre-heating the cool ware by radiation.

17. A porcelain enameling furnace as claimed in claim 13, further comprising heat exchanger and cooling means including a hot ware cooling zone located before said entrance/exit means for cooling the hot ware and for transferring heat across the surfaces from the hot ware to the cool ware so as to initially heat the same by convection, said heat exchanger and cooling further including a drying zone disposed adjacent and parallel to said hot ware cooling zone.

18. A procelain enameling furnace as claimed in claim 17, further comprising conduit means disposed outside of said pre-heating zone for directing the combustion gases from said U-shaped heat exchanger tubes into said drying zone for further initially heating of the cool ware by ejection.

* * * * *